US008228287B2

(12) United States Patent
JaeHun

(10) Patent No.: US 8,228,287 B2
(45) Date of Patent: Jul. 24, 2012

(54) LIQUID CRYSTAL DISPLAY DEVICE FOR REMOVING RIPPLE VOLTAGE AND METHOD OF DRIVING THE SAME

(75) Inventor: Song JaeHun, Suncheon-si (KR)

(73) Assignee: LG Display Co., Ltd., Seoul (KR)

( * ) Notice: Subject to any disclaimer, the term of this patent is extended or adjusted under 35 U.S.C. 154(b) by 854 days.

(21) Appl. No.: 11/298,275

(22) Filed: Dec. 8, 2005

(65) Prior Publication Data

US 2006/0244704 A1 Nov. 2, 2006

(30) Foreign Application Priority Data

Apr. 29, 2005 (KR) ..... 10-2005-0036091

(51) Int. Cl.
*G09G 3/36* (2006.01)

(52) U.S. Cl. ..... 345/103; 345/95

(58) Field of Classification Search ..... 345/52–58, 345/78, 90–98, 87, 101, 103
See application file for complete search history.

(56) References Cited

U.S. PATENT DOCUMENTS

| | | | | |
|---|---|---|---|---|
| 5,686,932 | A | 11/1997 | Tomita | |
| 5,831,605 | A | 11/1998 | Yasui et al. | |
| 6,222,516 | B1 * | 4/2001 | Oda et al. | 345/94 |
| 6,392,626 | B1 | 5/2002 | Moon | |
| 6,677,925 | B1 | 1/2004 | Kawaguchi et al. | |
| 2002/0063703 | A1 | 5/2002 | Furuhashi et al. | |
| 2004/0160400 | A1 | 8/2004 | Hong | |
| 2004/0164943 | A1 * | 8/2004 | Ogawa et al. | 345/92 |
| 2004/0263446 | A1 * | 12/2004 | Kawase et al. | 345/87 |
| 2005/0001807 | A1 * | 1/2005 | Lee et al. | 345/92 |
| 2005/0110738 | A1 * | 5/2005 | Kim et al. | 345/100 |
| 2007/0002005 | A1 * | 1/2007 | Kim et al. | 345/103 |

FOREIGN PATENT DOCUMENTS

KR 10-2001005369 A 7/2001

OTHER PUBLICATIONS

Office Action corresponding to German Patent Application No. 10 2005 062 509.6-32, dated Aug. 3, 2007.
Office Action issued in corresponding Korean Patent Application No. 10-2005-0036091, mailed Jun. 27, 2011.

* cited by examiner

*Primary Examiner* — Chanh Nguyen
*Assistant Examiner* — Long D Pham
(74) *Attorney, Agent, or Firm* — Brinks Hofer Gilson & Lione

(57) ABSTRACT

A LCD includes a liquid crystal panel having a first common voltage supply line and a second common voltage supply line, a common voltage generator, and a first common voltage compensator and a second common voltage compensator. The common voltage generator generates a first common voltage and a second common voltage. The first common voltage compensator and the second common voltage compensator generate a first compensated common voltage and a second compensated common voltage, respectively. The first compensated common voltage and the second compensated common voltage compensate for a first ripple voltage and a second ripple voltage in a first common voltage and a second common voltage generated at the first common voltage supply line and the second common voltage supply line, respectively.

10 Claims, 3 Drawing Sheets

LIQUID CRYSTAL DISPLAY DEVICE FOR REMOVING RIPPLE VOLTAGE AND METHOD OF DRIVING THE SAME

BACKGROUND OF THE INVENTION

1. Priority Claim

This application claims the benefit of priority from Korean Patent Application No. 036091/2005, filed Apr. 29, 2005.

2. Field of the Invention

The present invention relates to a liquid crystal display device, and more particularly, to a liquid crystal display device capable of preventing distortion of a common voltage.

3. Description of the Related Art

Some liquid crystal display devices (LCDs) display an image by controlling optical transmittance of liquid crystal cells according to video signals. Some LCDs may be active matrix LCDs. The active matrix LCD includes a plurality of pixels in which switching elements are arranged in a matrix. Thin film transistors (TFTs) are used as the switching elements.

FIG. 1 is a schematic view of a related art LCD. In FIG. 1, the related art LCD includes a liquid crystal panel 2, a gate driver 4 and a data driver 6 for driving the liquid crystal panel 2, a timing controller 8 for controlling the gate driver 4 and the data driver 6, and a common voltage generator 10 for supplying a common voltage Vcom to the liquid crystal panel 2.

The liquid crystal panel 2 includes a plurality of gate lines GL1 to GLn, a plurality of data lines DL1 to DLm, and pixel regions defined by intersections of the gate lines GL1 to GLn and the data lines DL1 to DLm. TFTs and pixel electrodes are arranged in the pixel regions.

The gate driver 4 sequentially supplies scan signals to the gate lines GL1 to GLn in response to gate control signals outputted from the timing controller 8. The data driver 6 supplies 1-line data signals to the data lines DL1 to DLm at horizontal periods (H1, H2, . . . ) in response to data control signals outputted from the timing controller 8. The timing controller 8 generates the gate control signals for controlling the gate driver 4 and the data control signals for controlling the data driver 6.

Using a power supply voltage (Vdd) generated from a DC/DC converter (not shown), the common voltage generator 10 generates the common voltage Vcom for driving the liquid crystal panel 2. The common voltage Vcom is supplied to the common voltage supply line VL on the liquid crystal panel 2.

A predetermined electric field is generated by the common voltage Vcom and the data signals supplied to the data lines DL1 to DLm. Due to this electric field, the liquid crystals are displaced and display an image.

The common voltage supply line VL is formed on the same layer as the gate line. A gate insulating layer is formed on the common voltage supply line VL and the data line is formed on the gate insulating layer. Accordingly, the gate insulating layer is interposed between the data line and the common voltage supply line VL. Due to the gate insulating layer, a parasitic capacitor may be formed between the common voltage supply line VL and the data line.

The common voltage supply line VL is positioned in parallel to the data lines along an edge portion of the liquid crystal panel 2. Also, the common voltage supply line VL is positioned close to the gate lines in parallel.

Due to the parasitic capacitor, if data signal values between the data lines are rapidly changed, ripples are generated in the common voltage, Vcom, supplied to the common voltage supply line VL. If the common voltage Vcom is distorted due to the ripples supplied to the liquid crystal panel 2, a crosstalk phenomenon is caused. In some LCDs, to eliminate the crosstalk phenomenon, a common voltage compensator 12 may be provided.

The common voltage compensator 12 compensates for the distorted common voltage Vcom and supplies the compensated common voltage to the liquid crystal panel 2. The common voltage compensator 12 is configured with an operational amplifier (e.g., an OP-Amp). The common voltage Vcom distorted by the parasitic capacitor during one frame may be compensated during a next frame. Consequently, the distortion of the common voltage is prevented and thus an image quality is enhanced.

Although the common voltage Vcom is partially compensated by the common voltage compensator 12, the common voltage is still distorted in an entire region of the liquid crystal panel 2 since the common voltage supply line (VL) has a line resistance. If the compensated common voltage is supplied to an upper portion of the liquid crystal panel 2, the compensated common voltage is not distorted in the upper portion. However, the common voltage is distorted more severely toward the middle or lower portion of the liquid crystal panel 2. Of course, the upper portion of the liquid crystal panel 2 far from the supply point of the common voltage may still be distorted. Thus, even though the compensated common voltage is supplied to the liquid crystal panel 2, a shutdown crosstalk is generated from the upper portion to the lower portion of the liquid crystal panel 2. This shutdown crosstalk is still severely problematic.

SUMMARY OF THE INVENTION

A LCD prevents distortion of a common voltage in a liquid crystal panel by supplying a compensated common voltage to common voltage supply lines of a liquid crystal panel.

A LCD includes a liquid crystal panel having a first common voltage supply line and a second common voltage supply line, a common voltage generator, and a first common voltage compensator and a second common voltage compensator. The common voltage generator generates a first common voltage and a second common voltage. The first common voltage compensator and the second common voltage compensator generate a first compensated common voltage and a second compensated common voltage, respectively. The first compensated common voltage and the second compensated common voltage compensate for a first ripple voltage and a second ripple voltage in a first common voltage and a second common voltage generated at the first common voltage supply line and the second common voltage supply line, respectively.

A method of driving a LCD includes supplying a first common voltage and a second common voltage to a first common voltage supply line and a second common voltage supply line, respectively; supplying a first ripple voltage and a second ripple voltage generated by the first common voltage supply line and the second common voltage supply line, respectively, to the first common voltage compensator and the second common voltage compensator; and supplying a first compensated common voltage and a second compensated common voltage to the first common voltage compensator and the second common voltage compensator. The first compensated common voltage and the second compensated common voltage may be obtained by reflecting the first ripple voltage on the first common voltage and reflecting the second ripple voltage on the second common voltage.

Other systems, methods, features and advantages of the invention will be, or will become apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. The components in the figures are not necessarily to scale, emphasis instead being placed upon illustrating the principles of the invention. Moreover, in the figures, like referenced numerals designate corresponding parts throughout different views.

DETAILED DESCRIPTION OF THE INVENTION

Figure 1:
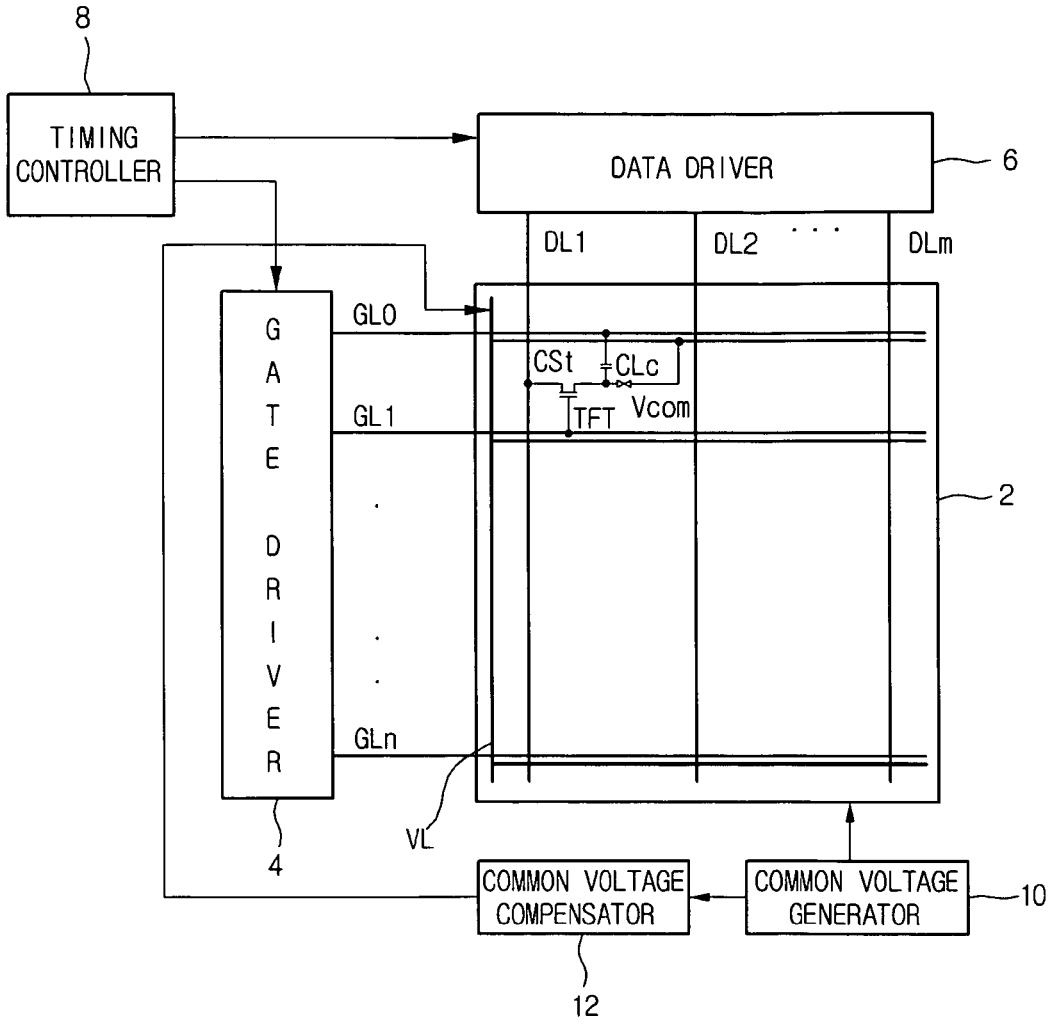
Fig.1 (Related Art)
FIG. 1 is a schematic view of a related art LCD.
Figure 2:
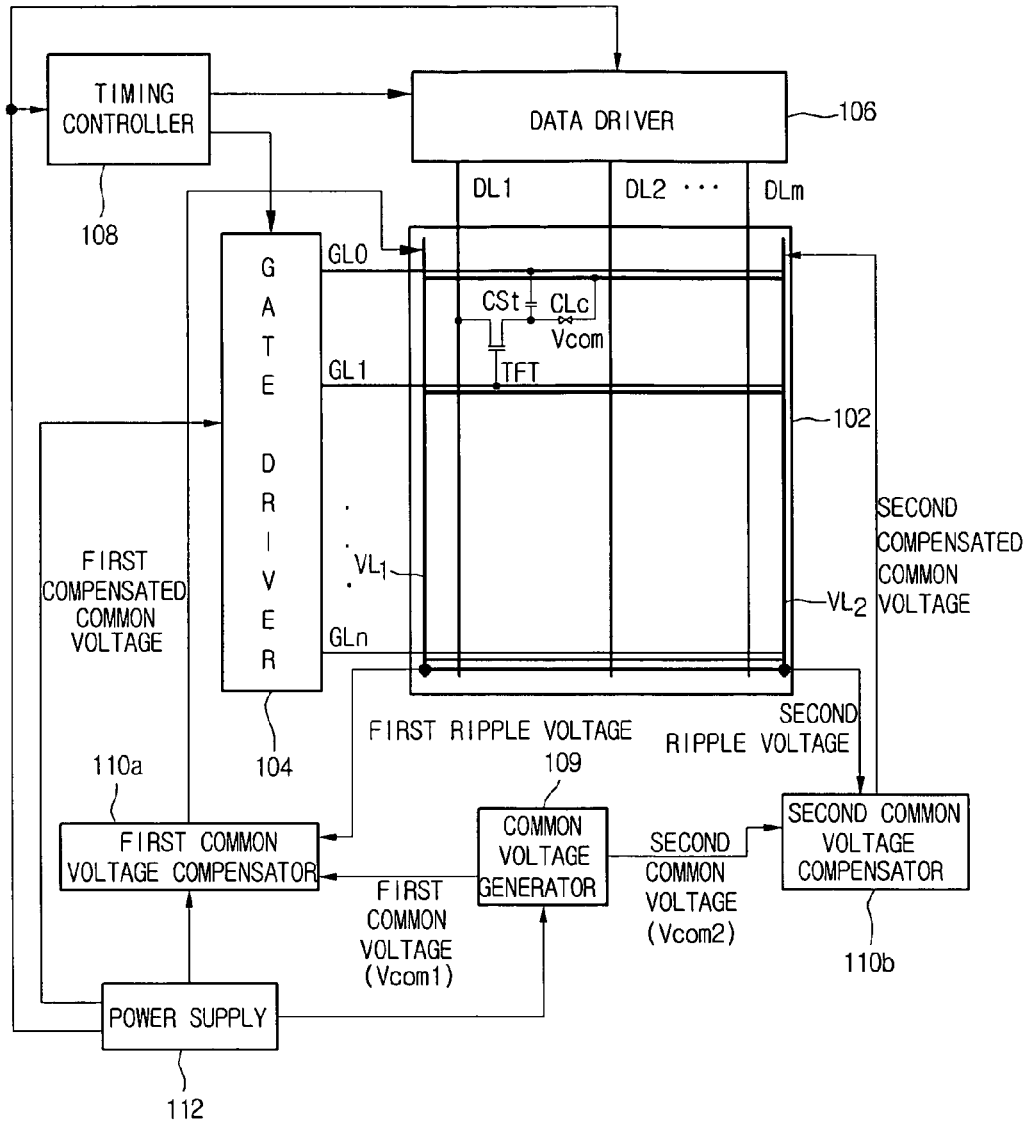
FIG. 2 is a schematic view of a LCD.

FIG. 2 is a schematic view of an LCD. In FIG. 2, a LCD includes a liquid crystal panel 102, a gate driver 104, a data driver 106, a timing controller 108, a common voltage generator 109, and first and second common voltage compensators 110*a* and 110*b*.

The liquid crystal panel 102 is an In-Plane Switching (IPS) liquid crystal panel in which a pixel electrode and a common electrode are arranged in the same plane. The liquid crystal panel 102 includes a plurality of gate lines GL1 to GLn, a plurality of data lines DL1 to DLm, and pixel regions. The pixel regions are defined by intersections of the gate lines GL1 to GLn and the data lines DL1 to DLm, and may be arranged in columns and rows, such as in a matrix. A reference symbol GL0 represents a dummy gate line through which a low voltage is supplied. TFTs and pixel electrodes are arranged in the pixel regions.

The gate lines may be arranged in a horizontal direction, and the data lines may be arranged in a vertical direction. First and second common voltage supply lines VL1 and VL2 may be arranged in parallel to the data lines. The first and second common voltage supply lines VL1 and VL2 may be spaced apart and may be positioned near the edges of the liquid crystal panel. Additionally, a separate common voltage supply line may connect the first and second common voltage supply lines VL1 and VL2. The separate common voltage supply line may be arranged parallel to the gate lines.

The gate driver 104 may sequentially supply scan signals to the gate lines GL1 to GLn of the liquid crystal panel 102. The data driver 106 supplies data signals to the data lines DL1 to DLm of the liquid crystal panel 102. The timing controller 108 may control the gate driver 104 and the data driver 106. The timing controller 108 may generate gate control signals for controlling the gate driver 104 and data control signals for controlling the data driver 106.

The gate driver 104 may generate the scan signals to the gate lines GL1 to GLn of the liquid crystal panel 102 in response to the gate control signals. The data driver 106 may generate the data signals to the data lines DL1 to DLm of the liquid crystal panel 102 in response to the data control signals.

In addition to the data signals, a common voltage may be used to display an image on the liquid crystal panel 102. The liquid crystal panel 102 may generate a predetermined electric field due to a potential difference between the data signal and the common voltage. Due to the electric field, liquid crystals may be displaced. The displaced liquid crystals block or transmit light emitted from an external light source (e.g., a backlight unit), thus displaying an image.

The common voltage is generated from the common voltage generator 109. The common voltage generator 109 generates the common voltage using a predetermined power supply voltage (Vdd) outputted from a power supply 112. The common voltage is compensated and supplied to the first and second common voltage supply lines VL1 and VL2. A first compensated common voltage and a second compensated common voltage are supplied to the first common voltage supply line VL1 and the second common voltage supply line VL2, respectively.

The first and second compensated common voltages may be generated by interfacing the first and second voltage supply lines and the common voltage generator 109 with the first and second common voltage compensators. A first common voltage compensator 110*a* may interface the common voltage generator 109 and the first common voltage supply line VL1 of the liquid crystal panel 102. Similarly, a second common voltage compensator 110*b* may interface the common voltage generator 109 and the second common voltage supply line VL2 of the liquid crystal panel 102.

The first common voltage compensator 110*a* may have input terminals connected to the common voltage generator 109 and to a first end of the first common voltage supply line VL1, such as a lower end. The first common voltage compensator 110*a* may also have an output terminal connected to a second end of the first common voltage supply line VL1, such as an upper end. Likewise, the second common voltage compensator 110*b* may have input terminals connected to the common voltage generator 109 and to a first end of the second common voltage supply line VL2, such as a lower end. The second common voltage compensator 110*b* may also have an output terminal connected to a second end of the second common voltage supply line VL2, such as an upper end.

The first common voltage compensator 110*a* receives a first common voltage Vcom1 from the common voltage generator 109 and a first ripple voltage from the first common voltage supply line VL1. The first common voltage compensator 110*a* may output a first compensated common voltage to compensate for a distortion of a common voltage supplied to the first common voltage supply line VL1. The first compensated common voltage may be a voltage obtained by inverting a phase of the first ripple voltage and reflecting it on the first common voltage. Alternatively, the first compensated common voltage may be a voltage obtained by reflecting the first ripple voltage on the first common voltage. When the first compensated common voltage is supplied to the first common voltage supply line VL1, the first ripple voltage generated at the first common voltage supply line VL1 is offset by the compensated common voltage. As a result, the pure first common voltage alone remains on the first common voltage supply line VL1.

The second common voltage compensator 110*b* receives a second common voltage Vcom2 from the common voltage generator 109 and a second ripple voltage from the second common voltage supply line VL2. The second common voltage compensator 110*b* may output a second compensated common voltage to compensate for a distortion of a common voltage supplied to the second common voltage supply line VL2. The second compensated common voltage may be a voltage obtained by inverting a phase of the second ripple voltage and reflecting it on the second common voltage.

Alternatively, the first compensated common voltage may be a voltage obtained by reflecting the second ripple voltage on the second common voltage. When the second compensated common voltage is supplied to the second common voltage supply line VL2, the second ripple voltage generated at the second common voltage supply line VL2 is offset by the compensated common voltage. As a result, the pure second common voltage alone remains on the second common voltage supply line VL2.

Although the first and second common voltages (Vcom1, Vcom2) may be identical to each other, the first and second ripple voltages may be identical to or different from each other, in magnitude and/or phase, depending on the layouts or arrangements of adjacent lines. When the first and second ripple voltages are identical to each other, the first and second compensated common voltages from the first and second common voltage compensators 110*a* and 110*b* are also identical to each other. When the first and/or second ripple voltages vary, the corresponding first and/or second compensated common voltage may vary in proportion to a variation width of the ripple voltage.

Accordingly, even though the first ripple voltage generated at the first common voltage supply line VL1 may vary, the first compensated common voltage may have substantially the same magnitude and inverted phase with respect to the first ripple voltage. The substantially similar first compensated common voltage may be supplied to the first common voltage supply line VL1. Therefore, the first ripple voltage generated at the first common voltage supply line VL1 may be removed. Likewise, even though the second ripple voltage generated at the second common voltage supply line VL2 may vary, the second compensated common voltage may have substantially the same magnitude and inverted phase with respect to the second ripple voltage. The substantially similar second compensated common voltage may be supplied to the second common voltage supply line VL2. Therefore, the second ripple voltage generated at the second common voltage supply line VL2 can be removed. Because the first and second compensated common voltages may be supplied at substantially the same time (e.g., simultaneously) to the first and second common voltage supply lines VL1 and VL2, it is possible to prevent the common voltage from being distorted due to the line resistances of the first and second common voltage supply lines VL1 and VL2.

During an operation of a LCD, timing controller 108 generates the gate control signals and the data control signals. The gate control signals and the data control signals are supplied to the gate driver 104 and the data driver 106, respectively. The gate driver 104 supplies scan signals to the gate lines GL1 to GLn of the liquid crystal panel 102 in response to the gate control signals. The data driver 106 supplies data signals to the data lines DL1 to DLm of the liquid crystal panel 102 in response to the data control signals.

The common voltage generator 109 generates a first and second common voltage using a power supply voltage (Vdd) supplied from the power supply 112. The common voltage generator 109 supplies the first common voltage to the first common voltage compensator 110*a* and supplies the second common voltage to the second common voltage compensator 110*b*.

The first common voltage compensator 110*a* receives the first common voltage Vcom1 from the common voltage generator 109 and the first ripple voltage from the first common voltage supply line VL1. The first common voltage compensator 110*a* supplies the first compensated common voltage to the first common voltage supply line VL1 of the liquid crystal panel 102. The first compensated common voltage may be a voltage obtained by inverting a phase of the first ripple voltage and reflecting it on the first common voltage. Alternatively, the first compensated common voltage may be a voltage obtained by reflecting the first ripple voltage on the first common voltage.

The second common voltage compensator 110*b* receives the second common voltage Vcom2 from the common voltage generator 109 and the second ripple voltage from the second common voltage supply line VL2. The second common voltage compensator 110*b* supplies the second compensated common voltage to the second common voltage supply line VL2 of the liquid crystal panel 102. The second compensated common voltage may be a voltage obtained by inverting a phase of the second ripple voltage and reflecting it on the second common voltage. Alternatively, the second compensated common voltage may be a voltage obtained by reflecting the second ripple voltage on the first common voltage.

In an initial driving operation, no common voltage is supplied to the liquid crystal panel 102. As a result, no ripple voltage is generated at the first and second common voltage supply lines VL1 and VL2. Accordingly, in an initial driving operation, the first and second common voltage compensators 110*a* and 110*b* supply the first and second common voltage supply lines VL1 and VL2 with the first and second common voltage generated from the common voltage generator 109.

In the liquid crystal panel 102, a predetermined electric field is generated due to a potential difference between the data signals supplied to the data lines DL1 to DLm and the first and second common voltages supplied to the first and second common voltage supply lines VL1 and VL2. Due to the electric field, the liquid crystals are displaced and an image is displayed.

Ripples may be generated in the common voltages supplied to the first and second common voltage supply lines VL1 and VL2 since the gate lines GL1-GLn and/or the data lines DL1-DLm overlap the first and second common voltage supply lines VL1 and VL2. The first ripple voltage generated at the first common voltage supply line VL1 is supplied to the first common voltage compensator 110*a*, and the second ripple voltage generated at the second common voltage supply line VL2 is supplied to the second common voltage compensator 110*b*.

The first common voltage compensator 110*a* supplies the first compensated common voltage to the first common voltage supply line VL1, and the second common voltage compensator 110*b* supplies the second compensated common voltage to the second common voltage supply line VL2.

The first ripple voltage is removed by the first compensated common voltage supplied to the first common voltage supply line VL1, and the second ripple voltage is removed by the second compensated common voltage supplied to the second common voltage supply line VL2. Consequently, crosstalk due to the ripple voltages can be prevented.

By supplying at substantially the same time (e.g., simultaneously) the first and second compensated common voltages to the first and second common voltage supply lines VL1 and VL2 positioned on both sides of the liquid crystal panel 102, it is possible to prevent the shutdown crosstalk generated at the upper and lower portions of the liquid crystal panel 102. The crosstalk may be generated due to the line resistances of the first and second common voltage supply lines VL1 and VL2. By supplying at substantially the same time the first and second compensated common voltages to the first and second common voltage supply lines VL1 and VL2, the distortion of the first compensated common voltage supplied to the first common voltage supply voltage VL1 due to the line resistance of the first common voltage supply line VL1 may be compensated by the second compensated common voltage supplied to the second common voltage supply line VL2. On the contrary, the distortion of the second compensated common voltage supplied to the second common voltage supply voltage VL1 is compensated by the first compensated common voltage supplied to the first common voltage supply line VL1. In this manner, the shutdown crosstalk can be prevented.

Figure 3:
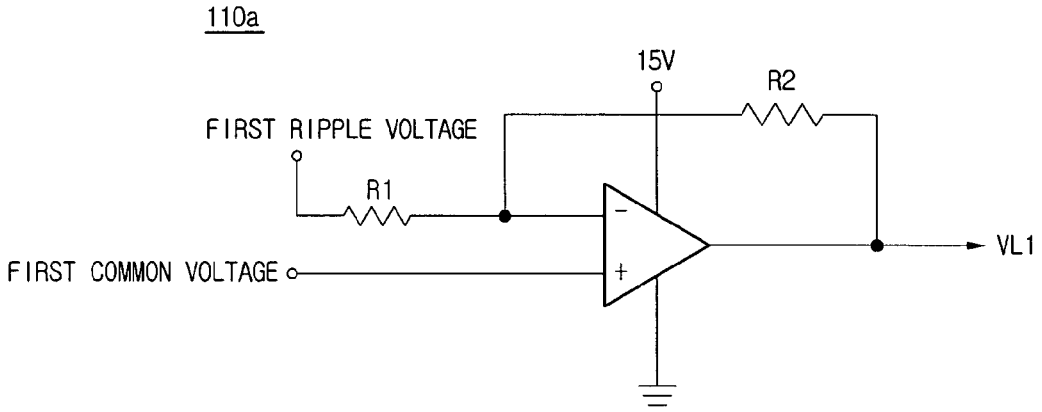
FIG. 3 is a circuit diagram of a first common voltage compensator.

The first and second common voltage compensators 110*a* and 110*b* may be configured with an operational amplifier (e.g., an OP-amp). FIG. 3 is a circuit diagram of a first common voltage compensator. In FIG. 3, the first common voltage compensator 110*a* may include an amplifier, and a first resistor R1 and a second resistor R2. The first common voltage from the common voltage generator 109 is supplied to a non-inverting (+) input terminal of the amplifier, and the first ripple voltage from the first common voltage supply line VL1 is supplied to an inverting (−) input terminal of the amplifier.

In the initial driving operation, no common voltage is supplied to the first common voltage supply line VL1 of the liquid crystal panel 102. As a result, the first ripple voltage is not generated. Accordingly, the first common voltage compensator 110*a* supplies the first common voltage to the first common voltage supply line VL1. In this case, the first ripple voltage is generated in the common voltage supplied to the first common voltage supply line VL1 due to the parasitic capacitor, and the first ripple voltage is supplied to the first common voltage compensator 110*a*. The first common voltage compensator 110*a* supplies the first compensated common voltage to the first common voltage supply line VL1. The first compensated common voltage is a voltage obtained by inverting the phase of the first ripple voltage and adding it to the first common voltage. Accordingly, the first ripple voltage generated at the first common voltage supply line VL1 is removed by the first compensated common voltage, thereby preventing the crosstalk.

Figure 4:
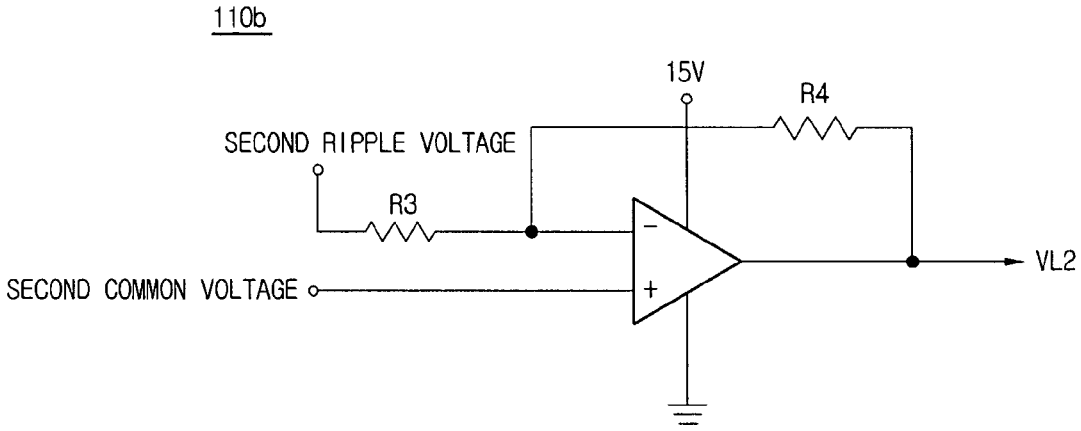
FIG. 4 is a circuit diagram of a second common voltage compensator.

FIG. 4 is a circuit diagram of a second common voltage compensator. In FIG. 4, the second common voltage compensator 110*b* may include an amplifier, and a third resistor R3 and a fourth resistor R4. The second common voltage from the common voltage generator 109 is supplied to a non-inverting (+) input terminal of the amplifier, and the second ripple voltage from the second common voltage supply line VL2 is supplied to an inverting (−) input terminal of the amplifier.

In the initial driving operation, no common voltage is supplied to the second common voltage supply line VL2 of the liquid crystal panel 102. As a result, the second ripple voltage is not generated. Accordingly, the second common voltage compensator 110*b* supplies the second common voltage to the second common voltage supply line VL2. In this case, the second ripple voltage is generated in the common voltage supplied to the second common voltage supply line VL2 due to the parasitic capacitor, and the second ripple voltage is supplied to the second common voltage compensator 110*b*. The second common voltage compensator 110*b* supplies the second compensated common voltage to the second common voltage supply line VL2. The second compensated common voltage is a voltage obtained by inverting the phase of the second ripple voltage and adding it to the second common voltage. Accordingly, the second ripple voltage generated at the second common voltage supply line VL2 is removed by the second compensated common voltage, thereby preventing the crosstalk.

It will be apparent to those skilled in the art that various modifications and variations can be made in the present invention. Thus, it is intended that the present invention covers the modifications and variations of this invention provided they come within the scope of the attached claims and their equivalent.

What is claimed is:

1. A liquid crystal display device comprising:

a liquid crystal panel having a plurality of gate lines, a plurality of data lines, a plurality of common lines, a first common voltage supply line and a second common voltage supply line spaced apart, wherein the first and second common voltage supply lines are connected to the plurality of common lines;

a common voltage generator for generating a first common voltage and a second common voltage and for supplying the first and second common voltages to the first and second common voltage supply lines respectively;

a first common voltage compensator to receive the first common voltage from the common voltage generator and directly receive a first ripple voltage from the first common voltage supply line and to compensate the first common voltage to output a first compensated common voltage to the first common voltage supply line;

a second common voltage compensator to receive the second common voltage from the common voltage generator and directly receive a second ripple voltage from the second common voltage supply line and to compensate the second common voltage to output a second compensated common voltage to the second common voltage supply line;

wherein the first common voltage supply line and the second common voltage supply line are arranged in parallel to the plurality of data lines around both edges of the liquid crystal panel, wherein the plurality of common lines are connected between the first and second common voltage supply lines in parallel to the plurality of gate lines, wherein the first compensated common voltage comprises a voltage obtained by inverting a phase of the first ripple voltage and adding the phase-inverted first ripple voltage to the first common voltage, wherein the second compensated common voltage comprises a voltage obtained by inverting a phase of the second ripple voltage and adding the phase-inverted second ripple voltage to the second common voltage, wherein when the first compensated common voltage is supplied to the first common voltage supply line, the first ripple voltage generated at the first common voltage supply line is offset by the first compensated common voltage, wherein when the second compensated common voltage is supplied to the second common voltage supply line, the second ripple voltage generated at the second common voltage supply line is offset by the second compensated common voltage, wherein the first and second compensated common voltages are simultaneously supplied to the first and second common voltage supply lines, respectively;

wherein the first common voltage and the second common voltage have different magnitudes.

2. The liquid crystal display device according to claim 1, wherein the first common voltage and the second common voltage have substantially equal magnitudes.

3. The liquid crystal display device according to claim 1, wherein when the first ripple voltage and the second ripple voltage have substantially equal magnitudes, the first and second compensated common voltages from the first and second common voltage compensators have substantially equal magnitude.

4. The liquid crystal display device according to claim 1, wherein the first ripple voltage and the second ripple voltage are substantially different magnitudes or phases.

5. The liquid crystal display device according to claim 1, wherein when the first ripple voltage varies, the first compensated common voltage varies in proportion to a variation width of the first ripple voltage.

6. The liquid crystal display device according to claim 1, wherein when the second ripple voltage varies, the second compensated common voltage varies in proportion to a variation width of the second ripple voltage.

7. The liquid crystal display device according to claim 1, wherein the first common voltage supply line and the second common voltage supply line are coupled together.

8. A method of driving a liquid crystal display device having a liquid crystal panel including a plurality of gate lines, a plurality of data lines, a plurality of common lines positioned along with the plurality of gate lines, a first common voltage supply line and a second common voltage supply line spaced apart, wherein the first and the second common voltage supply lines are connected to the plurality of common lines, comprising:

generating a first common voltage and a second common voltage;

supplying the first common voltage and the second common voltage to the first common voltage supply line and the second common voltage supply line, respectively;

directly supplying a first ripple voltage and a second ripple voltage to a first common voltage compensator and a second common voltage compensator, respectively, where the first ripple voltage is generated by the first common voltage supply line and the second ripple voltage is generated by the second common voltage supply line;

supplying the first common voltage and the second common voltage to the first common voltage compensator and the second common voltage compensator, respectively, inverting phases of the first and second ripple voltages and adding the phase-inverted first and second ripple voltages to the first and second common voltages to generate first and second compensated common voltages, respectively; and supplying the first compensated common voltage and the second compensated common voltage to the first common voltage supply line and the second common voltage supply line from the first and second common voltage compensators, respectively, wherein the first common voltage supply line and the second common voltage supply line are arranged in parallel to the plurality of data lines around both edges of the liquid crystal panel, wherein the plurality of common lines are connected between the first and second common voltage supply lines in parallel to the plurality of gate lines, wherein when the first compensated common voltage is supplied to the first common voltage supply line, the first ripple voltage generated at the first common voltage supply line is offset by the first compensated common voltage, wherein when the second compensated common voltage is supplied to the second common voltage supply line, the second ripple voltage generated at the second common voltage supply line is offset by the second compensated common voltage, wherein the first and second compensated common voltages are simultaneously supplied to the first and second common voltage supply lines, respectively, wherein the first common voltage and the second common voltage have different magnitudes.

9. The method according to claim 8, wherein when the first ripple voltage is varied, the first compensated common voltage is varied in proportion to a variation width of the first ripple voltage.

10. The method according to claim 8, wherein when the second ripple voltage is varied, the second compensated common voltage is varied in proportion to a variation width of the second ripple voltage.

* * * * *

UNITED STATES PATENT AND TRADEMARK OFFICE

CERTIFICATE OF CORRECTION

PATENT NO. : 8,228,287 B2
APPLICATION NO. : 11/298275
DATED : July 24, 2012
INVENTOR(S) : Song JaeHun It is certified that error appears in the above-identified patent and that said Letters Patent is hereby corrected as shown below:

On the Title Page

In the right column, item (56); under "FOREIGN PATENT DOCUMENTS", replace "10-2001005369 A" with --10-20010053693 A--.

Signed and Sealed this
Twenty-third Day of October, 2012

David J. Kappos

David J. Kappos
*Director of the United States Patent and Trademark Office*